US007181879B1

(12) United States Patent
Key

(10) Patent No.: US 7,181,879 B1
(45) Date of Patent: Feb. 27, 2007

(54) MILITARY RIBBON METHOD AND APPARATUS

(76) Inventor: Kelvin Key, 2060 Eclipse Dr., Middleburg, FL (US) 32068

( * ) Notice: Subject to any disclaimer, the term of this patent is extended or adjusted under 35 U.S.C. 154(b) by 77 days.

(21) Appl. No.: 11/073,216

(22) Filed: Mar. 7, 2005

(51) Int. Cl.
*G09F 3/18* (2006.01)

(52) U.S. Cl. ..... 40/661; 40/1.5

(58) Field of Classification Search ..... 40/1.5, 40/1.6, 661, 797, 904, 771, 772, 636
See application file for complete search history.

(56) References Cited

U.S. PATENT DOCUMENTS

| | | | | |
|---|---|---|---|---|
| 2,832,161 | A | 4/1958 | Murphy | |
| 2,926,439 | A * | 3/1960 | Holick | 40/1.5 |
| 3,134,484 | A | 5/1964 | Cox et al. | |
| 3,863,365 | A * | 2/1975 | Moliard | 434/289 |
| 4,385,688 | A | 5/1983 | Grant | |
| 4,869,004 | A * | 9/1989 | Maloney | 40/1.5 |
| 6,035,564 | A | 3/2000 | Cosmo et al. | |
| 6,108,957 | A | 8/2000 | Zapawa | |
| D469,120 | S | 1/2003 | Maloney | |
| 6,845,532 | B1 * | 1/2005 | Rosenblum | 5/482 |

* cited by examiner

*Primary Examiner*—Cassandra Davis

(57) ABSTRACT

A military ribbon method and apparatus includes a transparent panel that has a front side, a back side, an upper edge, a lower edge, a first side edge and a second side edge. A strap has a first end and a second end. The first end is attached to the bottom edge of the panel. A fastener is adapted for attaching the second end to the front side of the panel. The back side of the panel is placed in abutment with a front surface of a plurality of military ribbons so that the military ribbons are covered by and viewable through the panel. The strap is extended around a rear surface of the military ribbons and the second end of the strap is releasably attached to the front side of the panel so that the panel is secured to the military ribbons.

8 Claims, 2 Drawing Sheets

MILITARY RIBBON METHOD AND APPARATUS

BACKGROUND OF THE INVENTION

1. Field of the Invention

The present invention relates to protective covering devices and more particularly pertains to a new protective covering device for covering and protecting military ribbons from damage while allowing the viewing of the ribbons.

2. Description of the Prior Art

The use of protective covering devices is known in the prior art. U.S. Pat. No. 6,035,564 describes a device that is used for holding and protecting identification cards so that they may be on a shirt pocket. Another type of protective covering device is U.S. Pat. No. 6,108,957 which includes a generally transparent sleeve adapted for holding a ticket or other item to protect it from damage. Another such device is shown in U.S. Pat. No. 4,385,688 and is adapted for holding articles such as coins and the like.

While these devices fulfill their respective, particular objectives and requirements, the need remains for a device that is adapted for being positioned over military ribbons so that they are covered in order to protect the ribbons from being lost or damaged. The device should be adapted for covering the ribbons so that the ribbons are still viewable through the device.

SUMMARY OF THE INVENTION

The present invention meets the needs presented above by generally comprising a panel that has a front side, a back side, an upper edge, a lower edge, a first side edge and a second side edge. The panel is substantially transparent. A strap has a first end and a second end. The first end is attached to the bottom edge of the panel. A fastener is adapted for attaching the second end to the front side of the panel. The back side of the panel is placed in abutment with a front surface of a plurality of military ribbons so that the military ribbons are covered by and viewable through the panel. The strap is extended around a rear surface of the military ribbons and the second end of the strap is releasably attached to the front side of the panel so that the panel is secured to the military ribbons.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
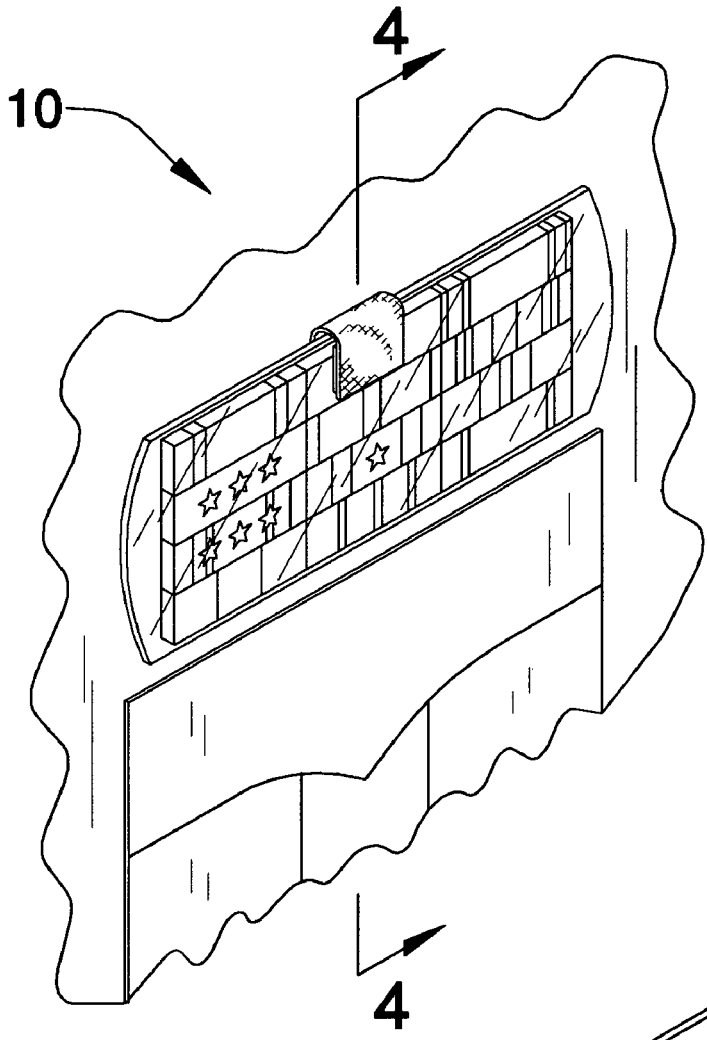
FIG. 1 is a perspective in-use view of a military ribbon method and apparatus according to the present invention.
Figure 2:
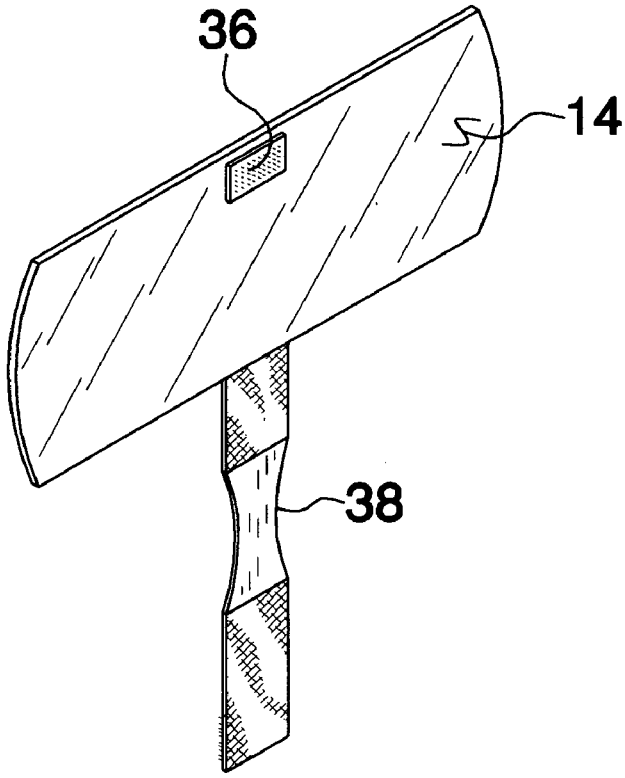
FIG. 2 is a perspective front view of the present invention.
Figure 3:
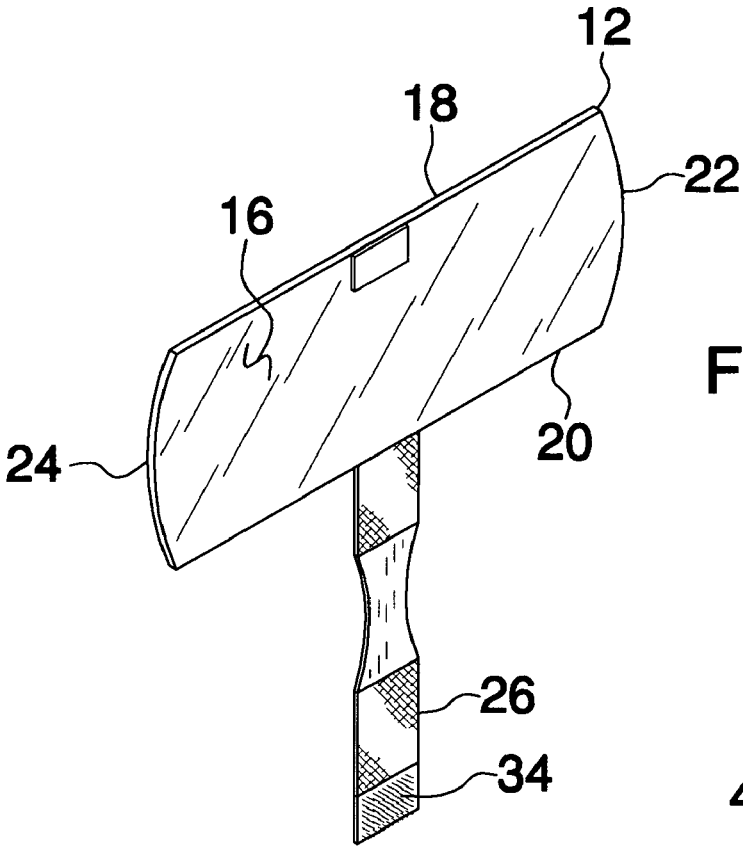
FIG. 3 is a perspective rear view of the present invention.
Figure 4:
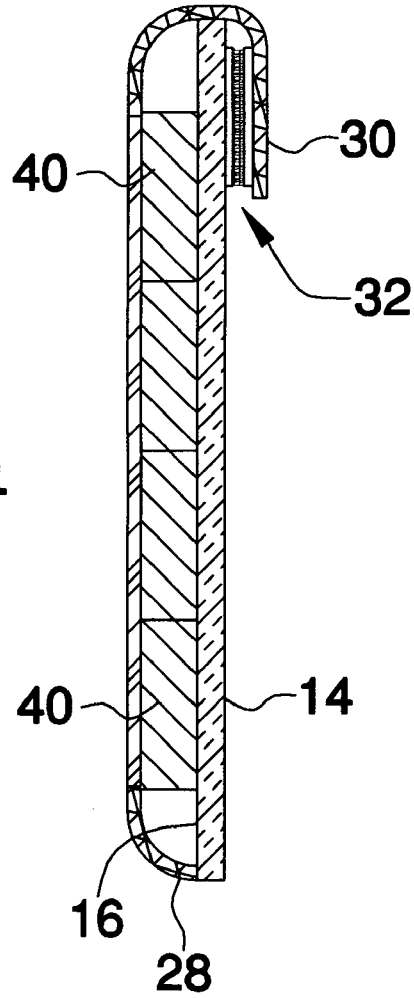
FIG. 4 is a cross-sectional view taken along line 4—4 of FIG. 1 of the present invention.

With reference now to the drawings, and in particular to FIGS. 1 through 4 thereof, a new protective covering device embodying the principles and concepts of the present invention and generally designated by the reference numeral 10 will be described.

As best illustrated in FIGS. 1 through 4, the military ribbon method and apparatus 10 generally comprises a panel 12 that has a front side 14, aback side 16, an upper edge 18, a lower edge 20, a first side edge 22 and a second side edge 24. The panel 12 is substantially transparent and has a height from the upper edge 18 to the lower edge 20 generally between 2 inches and 6 inches and a length from the first side edge 22 to the second side edge 24 generally between 4 inches and 5 inches. The first 22 and second 24 side edges are arcuate and extend outwardly away from each other. The panel 12 is preferably comprised of a plastic material.

A strap 26 has a first end 28 and a second end 30. The first end 28 is attached to the bottom edge 20 of the panel 12. A fastener 32 is adapted for attaching the second end 30 to the front side 14 of the panel 12. The fastener 32 comprises a hook and loop fastener that includes a first mating portion 34 attached to the strap 26 adjacent to the second end 30 and a second mating portion 36 attached to the front side 14 adjacent to the upper edge 18. The strap 26 is preferably comprised of a resiliently stretchable material and more preferably includes a central section 38 that is stretchable while portions of the strap 26 adjacent to the first 28 and second ends 30 are comprised of a non-elastic material.

In use, the back side 16 of the panel 12 is positioned in abutment with a front surface of a plurality of military ribbons 40 so that the military ribbons 40 are covered by and viewable through the panel 12. The strap 26 is extended around a rear surface of the military ribbons 40 and the second end 30 of the strap 26 is releasably attached to the front side 14 of the panel 12 so that the panel 12 is secured to the military ribbons 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of covering and protecting military ribbons comprising the steps of:

providing a panel having a front side, a back side, an upper edge, a lower edge, a first side edge and a second side edge, said panel being substantially transparent;

providing a strap having a first end and a second end, said first end being attached to said bottom edge of said panel, a fastener being adapted for attaching said second end to said front side of said panel, said fastener comprising a hook and loop fastener including a first mating portion attached to said strap adjacent to said second end and a second mating portion attached to said front side adjacent to said upper edge;

positioning said back side of said panel in abutment with a front surface of a plurality of military ribbons such that said military ribbons are covered by and viewable through said panel; and extending said strap around a rear surface of said military ribbons and releasably attaching said second end of said strap to said front side of said panel such that said panel is secured to said military ribbons.

2. The method according to claim 1, wherein said panel has a height from said upper edge to said lower edge generally between 2 inches and 6 inches and a length from said first side edge to said second side edge generally between 4 inches and 5 inches.

3. The method according to claim 1, wherein said first and second side edges are arcuate and extend outwardly away from each other.

4. The method according to claim 1, wherein said strap is resiliently stretchable.

5. A method of covering and protecting military ribbons comprising the steps of:

providing a panel having a front side, a back side, an upper edge, a lower edge, a first side edge and a second side edge, said panel being substantially transparent, said panel having a height from said upper edge to said lower edge generally between 2 inches and 6 inches and a length from said first side edge to said second side edge generally between 4 inches and 5 inches, said first and second side edges being arcuate and extending outwardly away from each other;

providing a strap having a first end and a second end, said first end being attached to said bottom edge of said panel, a fastener being adapted for attaching said second end to said front side of said panel, said fastener comprising a hook and loop fastener including a first mating portion attached to said strap adjacent to said second end and a second mating portion attached to said front side adjacent to said upper edge, said strap being resiliently stretchable;

positioning said back side of said panel in abutment with a front surface of a plurality of military ribbons such that said military ribbons are covered by and viewable through said panel; and extending said strap around a rear surface of said military ribbons and releasably attaching said second end of said strap to said front side of said panel such that said panel is secured to said military ribbons.

6. A method of covering and protecting military ribbons comprising the steps of:

providing a panel having a front side, a back side, an upper edge, a tower edge, a first side edge and a second side edge, said panel being substantially transparent;

providing a strap having a first end and a second end, said first end being attached to said bottom edge of said panel, a fastener being adapted for attaching said second end to said front side of said panel, said strap being resiliently stretchable;

positioning said back side of said panel in abutment with a front surface of a plurality of military ribbons such that said military ribbons are covered by and viewable through said panel; and extending said strap around a rear surface of said military ribbons and releasably attaching said second end of said strap to said front side of said panel such that said panel is secured to said military ribbons.

7. The method according to claim 6, wherein said panel has a height from said upper edge to said lower edge generally between 2 inches and 6 inches and a length from said first side edge to said second side edge generally between 4 inches and 5 inches.

8. The method according to claim 6, wherein said first and second side edges are arcuate and extend outwardly away from each other.

* * * * *